United States Patent [19]

Dengler et al.

[11] Patent Number: 4,697,741

[45] Date of Patent: Oct. 6, 1987

[54] ARRANGEMENT FOR QUICKLY CHANGING NOZZLES ON A SPRAYING APPARATUS

[75] Inventors: Alfred Dengler, Deckenpfronn; Eberhard Medler, Sindelfingen, both of Fed. Rep. of Germany

[73] Assignee: Daimler-Benz Aktiengesellschaft, Fed. Rep. of Germany

[21] Appl. No.: 662,161

[22] Filed: Oct. 18, 1984

[30] Foreign Application Priority Data

Oct. 19, 1983 [DE] Fed. Rep. of Germany ..... 3337980

[51] Int. Cl.[4] ..... B05B 13/06

[52] U.S. Cl. ..... 239/391; 901/30; 29/26 A; 29/157 C; 285/316

[58] Field of Search ..... 239/390, 391, 392, 394, 239/395, 397, 436, 437, 442; 118/302, 313; 285/316, 325; 901/30, 41, 43; 414/729; 29/26 A, 157 C; 408/56

[56] References Cited

U.S. PATENT DOCUMENTS

| | | | |
|---|---|---|---|
| 458,762 | 9/1891 | Charonnat | 239/395 X |
| 2,409,650 | 10/1946 | Wiggins | 285/316 |
| 3,477,870 | 11/1969 | Boretti et al. | 118/302 X |
| 3,516,611 | 6/1970 | Piggott | 239/394 X |
| 3,674,207 | 7/1972 | Carbonetti, Jr. et al. | 239/397 X |
| 3,752,117 | 8/1973 | Hammelmann | 118/302 |
| 3,779,533 | 12/1973 | Etter | 239/394 |
| 4,164,879 | 8/1979 | Martin | 408/56 X |
| 4,437,610 | 3/1984 | Huber et al. | 239/392 X |
| 4,512,709 | 4/1985 | Hennekes et al. | 414/729 |
| 4,604,787 | 8/1986 | Silvers, Jr. | 29/26 A X |

FOREIGN PATENT DOCUMENTS

| | | | |
|---|---|---|---|
| 1066503 | 10/1959 | Fed. Rep. of Germany | 239/395 |
| 3004495 | 8/1981 | Fed. Rep. of Germany | 118/313 |

*Primary Examiner*—Andres Kashnikow
*Assistant Examiner*—Mary Beth O. Jones

[57] ABSTRACT

A device is provided for spraying an anti-corrosion agent into the hollow spaces of a vehicle body wherein one spraying nozzle, selected from a set of spraying nozzles which are each specific to a portion of the vehicle body, can be selectively coupled fluidically and mechanically by means of a quick change slip-on coupling to a spraying nozzle holder apparatus. To facilitate quick spraying nozzle changes by one hand operation and to make it possible to employ robots for the purpose of changing nozzles, all spraying nozzles are retained next to one another in a defined manner by retainers on a support so as to be fixed but detachable from said retainers. This arrangement permits the coupling component part of each nozzle to be easily accessible to the spraying nozzle holder apparatus.

13 Claims, 4 Drawing Figures

ARRANGEMENT FOR QUICKLY CHANGING NOZZLES ON A SPRAYING APPARATUS

BACKGROUND AND SUMMARY OF THE INVENTION

The invention relates generally to an arrangement for spraying an anti-corrosion agent into the hollow spaces of a vehicle body wherein a portable spraying nozzle holder is connected to a source of anti-corrosion agent and air, and at least one spraying nozzle and quick change slip-on couplings are provided for connecting said spraying nozzle holder to said nozzle. Such a device is disclosed in German Offenlegungsschrift No. 3,004,495.

In manually applying a preservative to hollow spaces in a vehicle body a worker treats up to six hollow spaces or locations to be preserved within one time cycle. Each hollow space or area to be preserved is coated using a specific spraying nozzle developed for this space or area. The spraying operation itself is relatively short, but a considerable portion of the working time within a cycle is required for changing the nozzle. It is believed that preserving hollow spaces mechanically has previously been done only by special machines which were specially designed for a particular body type. With these machines it is either completely impossible to convert to other body types or the time taken to do so is unacceptably long.

An object of the invention is to improve the known spraying device so that a worker may manually change the nozzle more quickly than previously by employing a so-called one hand operation. Moreover, this invention may be used in combination with industrial robots thereby providing means for mechanical application of preservative to hollow spaces which are readily adaptable to a variety of vehicle body types.

These objects are achieved according to the invention by the arrangements as disclosed herein. Because of the described fixed orientation of the various spraying nozzles, a worker can with one hand manually guide the spraying nozzle holder onto one of the awaiting nozzles and remove this nozzle/holder assembly from a retainer. Conversely, it is also possible with one hand operation to deposit the spraying nozzle back into its retainer. In a like manner the arm of an industrial robot could pick up the spraying nozzles one after the other and place them back into their retainers. It is merely necessary to program the picking up and depositing of the spraying nozzles into the movement program of the industrial robot.

Further objects, features and advantages of the present invention will become more apparent from the following description when taken with the accompanying drawings which show, for purposes of illustration only, embodiments constructed in accordance with the present invention.

DETAILED DESCRIPTION OF THE DRAWINGS

Figure 1:
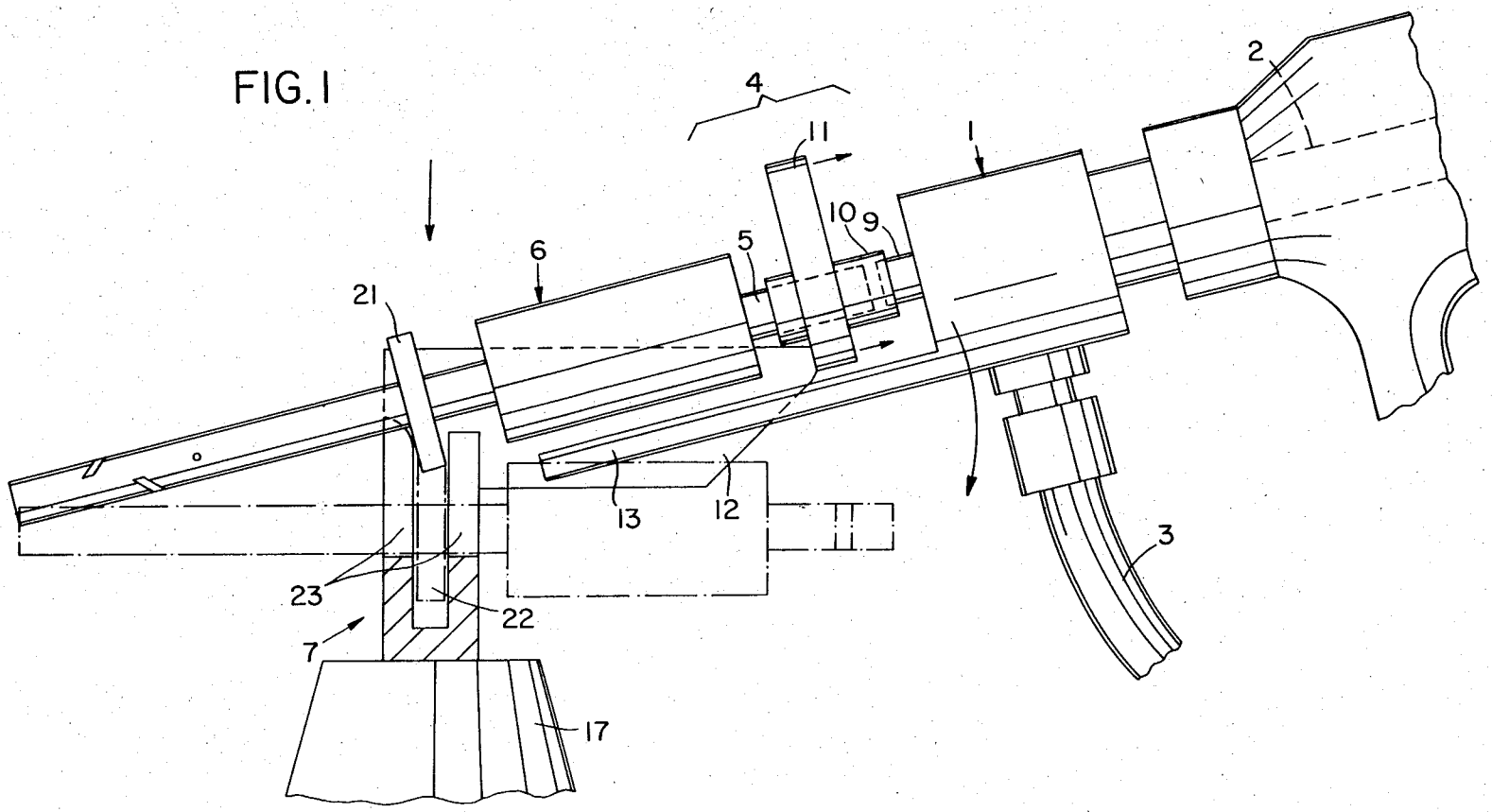
FIG. 1 is a partial side schematic sectional view of a spraying nozzle in a retainer with a manually guided spraying nozzle holder.
Figure 2:
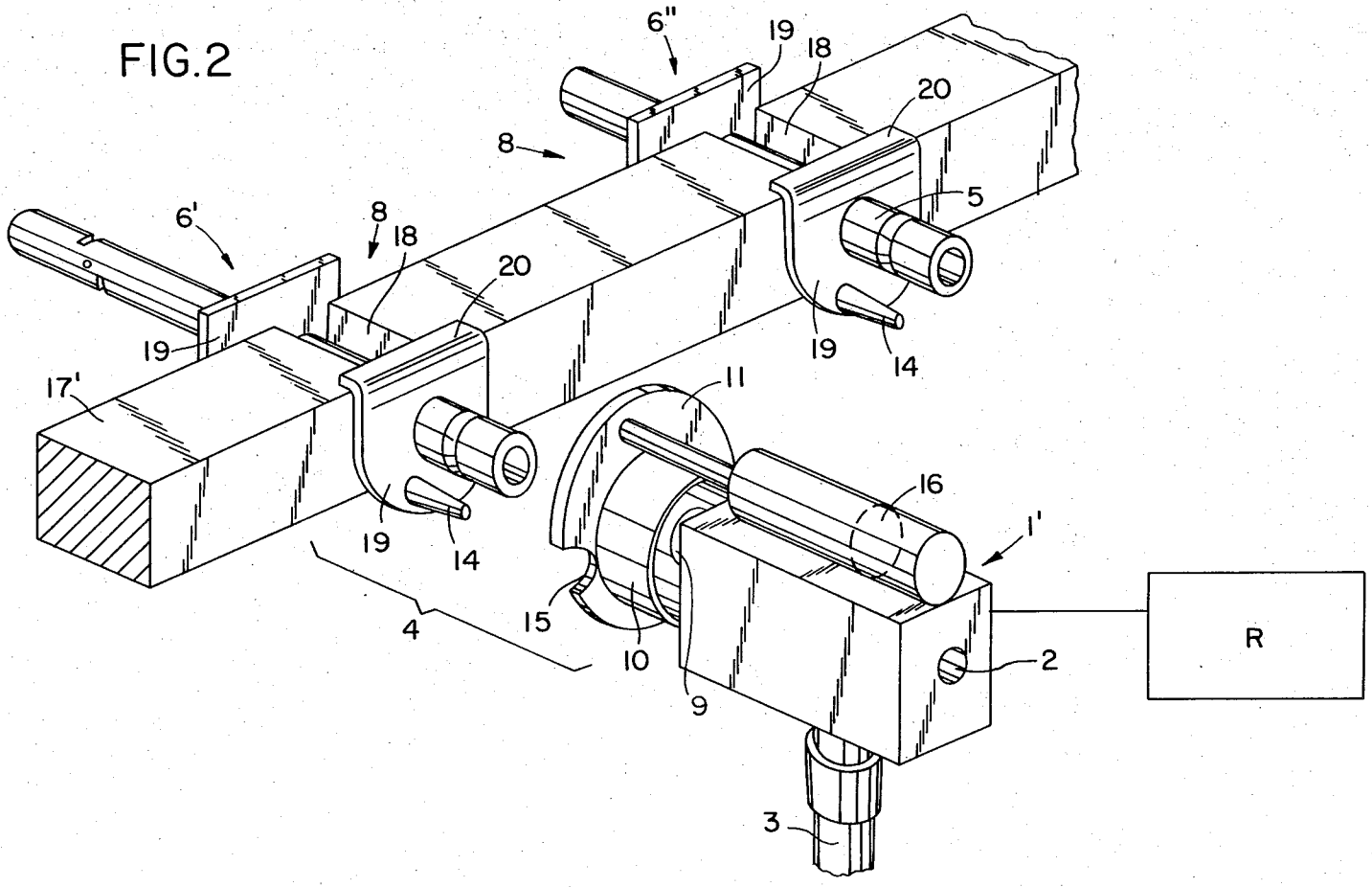
FIG. 2 is a perspective view of a spraying nozzle in a retainer with a mechanically guided spraying nozzle holder.

The spraying nozzle holder apparatus 1 and 1' are shown in FIGS. 1 and 2, respectively. Feed line 2 supplying an anti-corrosion agent and atomizer airline 3 are also indicated in FIGS. 1 and 2. The anti-corrosion agent is usually a wax capable of good plastic flow with a strong water-repellent property and high viscosity. The spraying nozzle holders 1 and 1' can in each case be fitted together with the spray nozzle 6 of FIG. 1, 6' and 6'' of FIG. 2, and 6''' of FIGS. 3 and 4 both fluidically and mechanically via a quick change slip-on coupling 4. A coupling component piece 5 is allocated to each of the individual spraying nozzles 6, 6', 6'' and 6''', and a corresponding counterpart 9 is allocated to the spraying nozzle holder 1 or 1'. A release member 10, which is preferably designed as an axially displaceable sleeve, is carried by the counterpart 9. In order to release the quick change slip-on coupling, the axially displaceable sleeve is displaced in the direction of the spraying nozzle holder. Alternatively, a bayonet coupling or a slip-on coupling with a bayonet catch can also be used according to other advantageous preferred embodiments of the invention. In this alternative bayonet embodiment, fitting together or releasing the coupling would require relative rotational movement between the nozzle holder and the nozzle. Accordingly, the releasing device would require rotary drive.

The various spraying nozzles required for one working cycle at a work location are retained horizontally next to one another in a fixed position in spraying nozzle retainers 7 (FIG. 1) or 8 (FIG. 2). In the illustrative embodiment shown in FIG. 1, the spraying nozzle is provided with a safety collar 21 which is inserted between two retaining forks 23 of the respective retainers 7. The two retaining forks 23 define between them a locating slot 22. When the spraying nozzle is deposited in the slot it is prevented from rotating by providing a non-circular safety collar with appropriate flat areas on the periphery. Such a collar interacts with a complementary non-circular mating surface in the locating slot 22. Consequently, the spraying nozzle is retained in a fixed manner in the axial, radial and rotational directions. Because of such fixed retention of the spraying nozzle including its coupling component piece 5, the nozzle protrudes from retainer support 17 in a direction as shown with a chain-dotted line in FIG. 1. In a preferred embodiment, the nozzle with retainer shown in FIG. 1 is one of a series of nozzles with retainers arranged next to one another such that each nozzle protrudes in the same direction. Each nozzle can then be easily reached by the spraying nozzle holder 1 or the counterpart 9 of the quick change slip-on coupling attached to the front of the spraying nozzle holder 1. As a result of this arrangement, the spraying nozzle holder can be connected to a nozzle using just one hand to guide the spraying nozzle holder and thereby axially engage the quick change slip-on coupling together.

Instead of being supported next to one another in parallel straight lines, the spraying nozzles can also be arranged in a star-like or drum-like formation on a carousel according to other contemplated embodiments of the invention. The particular spraying nozzle required can then be brought into a favorable release position for the worker or industrial robot. This can reduce the working area required during the nozzle change both with a manually guided and a mechanically guided spraying nozzle holder. With the manual operating methods, this arrangement has a spatially beneficial effect resulting in less time pressure on the worker. With the mechanical operating method, industrial robots can thereby be used in a smaller working area resulting in a more cost effective operation.

To render a nozzle change possible, the nozzle used beforehand has to be deposited into the retainer 7 allocated to it. To render this change possible with one hand operation, the release member 10, the movable sleeve of the quick change slip-on coupling 4, is provided with a radially projecting collar 11. A fixed stop 12 is attached to the retainer 7. This stop 12 extends far enough in the direction of the spraying nozzle holder so that when the safety collar 21 is approximately in the same axial position as the locating slot 22, the collar 11 is butted against the stop 12 and displaced the distance of the coupling release stroke in the direction of the spraying nozzle holder 1. In this configuration, the quick change slip-on coupling is released. Usually the quick change slip-on coupling is provided with an ejector spring so that the coupling counterpart 5 is ejected after the release. To be able to deposit the uncoupled spraying nozzle safely in the retainer 7, a depositing tongue 13 is attached to the spray nozzle holder. This tongue 13 extends below the spraying nozzle 6 and prevents the spraying nozzle 6 from being dropped. The stop 12 is attached in the lateral position such that when the spraying nozzle is removed from the retainer 7 the collar 11 can be moved past the stop.

Although as shown, releasing the quick change slip-on coupling when depositing the spraying nozzle is possible with one hand operation of the spraying nozzle holder, this operation requires a certain amount of attention. It is also contemplated in an alternative embodiment of this invention to couple the sleeve 10 shown in FIG. 2 with a pneumatically charged working piston 16 and to attach to the spraying holder a valve which can be operated in an energy efficient manner for charging this working piston. The aforementioned collar 11 and the stop 12 can then be eliminated. The piston modified spraying nozzle holder will of course be more expensive and heavier as a result of the pneumatically chargeable working piston and the corresponding control valve.

In the manual operation method of hollow space preservation, the individual spraying nozzles are provided with auxiliary positioning means for precisely aligning the spraying nozzles to a vehicle body during spraying. For example, appropriate stop plates for aligning in the downward direction, the angular position, and the rotational position are attached to the spraying nozzles. For this reason, the relative rotational orientation between the spraying nozzles are fitted together with the spraying nozzle holder is not critical.

In the illustrative embodiment shown in FIG. 2, the retainers 8 for the individual spraying nozzles have a different design than the design of retainers 7 in the illustrative embodiment according to FIG. 1. Several recesses 18 of U-shaped cross section into which the spraying nozzles can be inserted are incorporated adjacent one another in the deposit or retainer support 17'. Lock plates 19, attached to the spraying nozzle, run, in a direction normal to the axis of the spraying nozzles and grip the deposit support at the front and rear, thereby ensuring exact axial positioning of the spraying nozzles. Exact radial positioning is ensured by the configuration of the recess 18. To ensure a definite rotational orientation of the spraying nozzles in the deposited location, one of the lock plates is provided with an angle stop 20 extending around an edge of the deposit support 17'.

In preserving hollow spaces mechanically by means of an industrial robot R of FIG. 2, a reproducible and precise positioning of the spraying nozzles into the hollow spaces to be treated can be ensured without corresponding auxiliary positioning means on the spraying nozzle itself. In contrast with the manual methods, it is necessary when using an industrial robot that the relative rotational orientation between the spraying nozzle and the spraying nozzle holder remain constant. To ensure this, the spraying nozzles 6' and 6'' having a mechanically guided spraying nozzle 1' as shown by the illustrative embodiment in FIG. 2 are each provided with an anti-rotation pin 14 located on lock plate 19 which engages a corresponding recess 15 in the collar 11 of the coupling sleeve 10. This anti-rotation pin member axially interlocks when the quick change slip-on coupling is engaged and ensures a constant relative rotational orientation between the spraying nozzle and the spraying nozzle holder. In the illustrative embodiment of FIG. 2, the spraying nozzles when returned to the retainer are released in the manner described previously by means of a pneumatically chargeable working piston 16 which operates directly or indirectly on the sleeve 10.

Figure 3:
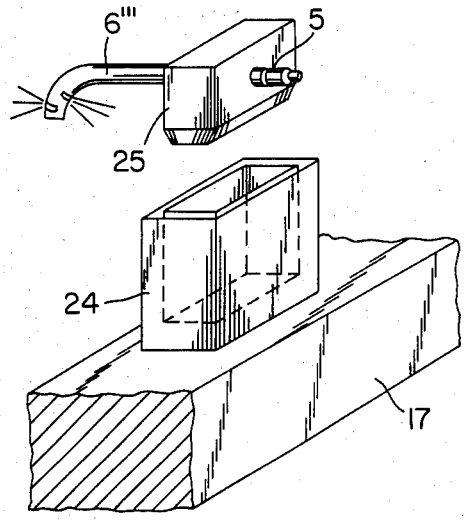
FIG. 3 is a perspective view of an alternative embodiment of the spraying nozzle and retainer arrangement.
Figure 4:
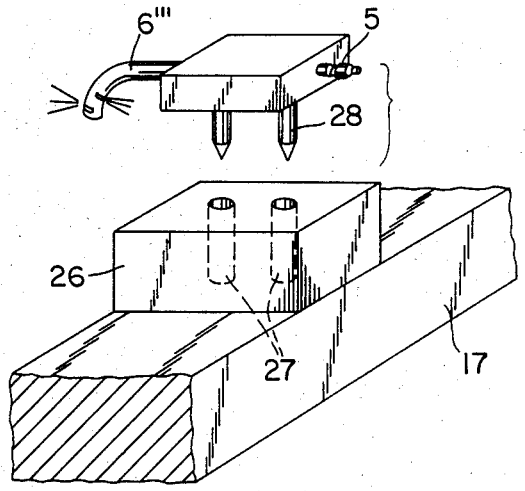
FIG. 4 is a perspective view of another embodiment of this spraying nozzle and retainer arrangement of the present invention.

FIG. 3 and 4 show alternate embodiments of retainers for ensuring constant positioning of the spraying nozzles 6''', each of which is provided with a positioning member. In the illustrative embodiment according to FIG. 3, this positioning member consists of a cube-like lock pin 25, the lower edges of which are bevelled to facilitate insertion into the complementary fixture on the deposit support 17. This complementary fixture comprises a locating shaft 24 having a shape similar to the lock pin 25. Because of the cube-like shape of the lock pin and the locating shaft, axial, radial, and rotational movement of the nozzle is prevented and a constant spatial orientation is determined.

In the illustrative embodiment according to FIG. 4, two round locking pins project downward in parallel relation from a cube-like spray nozzle positioning means. These locking pins are also bevelled at the bottom to facilitate insertion into a deposit block 26. When the spraying nozzle support means is being deposited into the retainer 17, the lock pins can be inserted into corresponding locating holes 27 of the deposit block 26 by which means a constant deposited position is ensured.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A spraying arrangement for accommodating spraying of a variety of surfaces having different geometric shape configurations utilizing a plurality of differently configured spraying nozzle means and a common spray medium supply line comprising:

movable nozzle holder means capable of being selectively coupled with one of said nozzle means, said nozzle holder means being fluidly communicable with a source of fluid spray medium, quick change coupling means for fluidly and mechanically coupling said movable nozzle holder means with said one nozzle means, said coupling means comprising a first portion on said nozzle holder means and a second portion on said nozzle means, and nozzle retainer means for holding said nozzle means in a fixed position, said one nozzle means being capable of being removed from said nozzle retainer means after coupling with said nozzle holder means, wherein said retainer means prevent radial and axial displacement of said nozzle means, wherein said retainer means prevent rotational displacement of said nozzle means, including depositing means provided on said nozzle holder means for depositing said nozzle means in said retainer means, wherein said depositing means comprises depositing tongue means extending below said spraying nozzle means.

2. A spraying arrangment for accommodating spraying of a variety of surface having different geometric shape configurations utilizing a plurality of differently configured spraying nozzle means and a common spray medium supply line comprising:

movable nozzle holder means capable of being selectively coupled with one of said nozzle means, said nozzle holder means being fluidly communicable with a source of fluid spray medium, quick change coupling means for fluidly and mechanically coupling said movable nozzle holder means with said one nozzle means, said coupling means comprising a first portion on said nozzle holder means and a second portion on said nozzle means, and nozzle retainer means for holding said nozzle means in a fixed position, said one nozzle means being capable of being removed from said nozzle retainer means after coupling with said nozzle holder means, said quick-change coupling means comprises an axially displaceable sleeve means connected to said nozzle holder means, wherein said axially displaceable sleeve means is provided with radially extending collar means and said retainer means is provided with longitudinally extending stop means for axially displacing said axially displaceable sleeve means on said nozzle holder means through physical contact with said collar means when said one nozzle means is inserted into said nozzle retainer means, to thereby uncouple said nozzle holder means and said one nozzle means.

3. An arrangement according to claim 2, further comprising programmable control means for controlling said movable nozzle holder means, wherein said programmable control means comprises robotic means.

4. A spraying arrangement according to claim 2, wherein said one nozzle means are capable of dispensing a viscous fluid for treating said surfaces.

5. A spraying arrangement according to claim 2, further comprising locking means for preventing relative rotation between said nozzle means and said nozzle means.

6. A spraying arrangement according to claim 5, wherein said locking means is located on said nozzle holder means.

7. A spraying arrangement according to claim 2, wherein said coupling means includes means for preventing relative rotation of said first portion and of said second portion.

8. A spraying arrangement for accommodating spraying of a variety of surfaces having different geometric shape configurations utilizing a plurality of differently configured spraying nozzle means and a common spray medium supply line comprising:

movable nozzle holder means capable of being selectively coupled with one of said nozzle means, said nozzle holder means being fluidly communicable with a source of fluid spray medium, quick change coupling means for fluidly and mechanically coupling said movable nozzle holder means with said one nozzle means, said coupling means comprising a first portion on said nozzle holder means and a second portion on said nozzle means, and nozzle retainer means for holding said nozzle means in a fixed position, said one nozzle means being capable of being removed from said nozzle retainer means after coupling with said nozzle holder means, said quick-change coupling means comprises an axially displaceable sleeve means connected to said nozzle holder means, including piston means mounted in said nozzle holder means, said piston means being directly attached to said axially displaceable sleeve means for axially displacing said sleeve means.

9. An arrangement according to claim 8, further comprising programmable control means for controlling said movable nozzle holder means, wherein said programmable control means comprises robotic means.

10. A spraying arrangement according to claim 8, wherein said nozzle means are capable of dispensing a viscous fluid for treating said surfaces.

11. A spraying arrangement according to claim 8, further comprising locking means for locking said quick change coupling means.

12. A spraying arrangement according to claim 11, wherein said locking means is located on said nozzle holder means.

13. A spraying arrangement according to claim 8, wherein said coupling means includes means for preventing relative rotation of said first portion and of said second portion.

* * * * *